United States Patent [19]

Marks

[11] 3,991,926

[45] Nov. 16, 1976

[54] SWATCH CUTTING AND BINDING APPARATUS AND METHOD

[75] Inventor: William M. Marks, Irvington, N.Y.

[73] Assignee: General Foods Corporation, White Plains, N.Y.

[22] Filed: July 23, 1975

[21] Appl. No.: 598,489

[52] U.S. Cl. ..... 227/21; 227/50; 227/76; 227/100; 83/153; 83/277; 83/650

[51] Int. Cl.[2] ..... B27F 7/08

[58] Field of Search ..... 227/21, 39, 40, 50, 227/64, 76, 99, 100, 101; 83/153, 277, 650

[56] References Cited

UNITED STATES PATENTS

| | | | |
|---|---|---|---|
| 775,539 | 11/1904 | McConnell | 227/76 |
| 3,546,990 | 12/1970 | Schneider | 83/153 |
| 3,701,299 | 10/1972 | Stumpf | 83/277 |
| 3,774,486 | 11/1973 | Johnsson | 83/277 |

*Primary Examiner*—Granville Y. Custer, Jr.
*Attorney, Agent, or Firm*—C. Garman Hubbard; Thomas V. Sullivan; Bruno P. Struzzi

[57] ABSTRACT

Several different webs of textile material or other like fabric are simultaneously unwound from their respective rolls and are fed in intermittent stepwise fashion in superposed relation to one another to the bed of a cutting press. The press head is provided with cutting knives arranged to sever from each web along its leading edge a strip portion of predetermined area which in turn is subdivided by the cutting knives into sections each comprising a pile of individual swatches. The press head is also provided with a plurality of stitching devices arranged to bind together during each cyclic operation of the press head the several swatches of each section severed from the respective layers of web material so as to form a corresponding plurality of bound swatch pads. Upon the return stroke of the press head, the bound pads are removed from the bed of the press in preparation for the next web cutting and stitching operation. If desired, each pad is also provided with a backing or support sheet of cardboard or the like. This is accomplished by feeding a strip of such backing material into the press bed in a direction transverse to the direction of web feed so as to register with the leading edges of the several superposed webs of fabric, whereby on the cutting and stitching stroke of the press head the strip of backing material will also be subdivided into sections each of which will be stitched to the pile of individual swatches in superposed registry therewith to thereby form swatch pads having a backing support integral therewith.

12 Claims, 20 Drawing Figures

INTERVAL 1.

INTERVAL 4

FIG. 13.
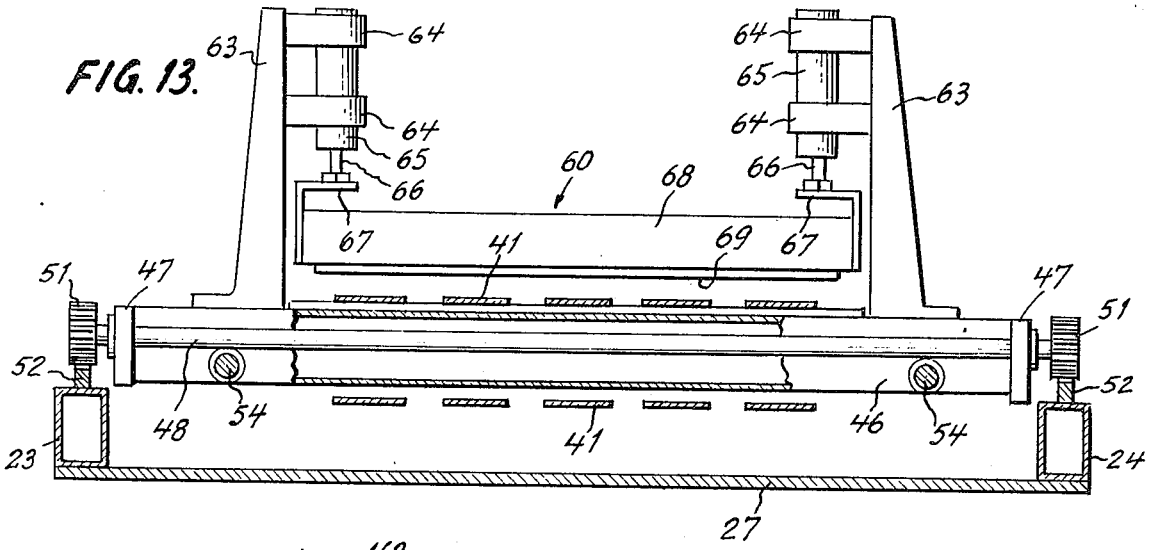
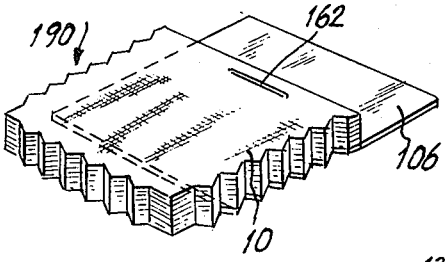
FIG. 14.
FIG. 15.
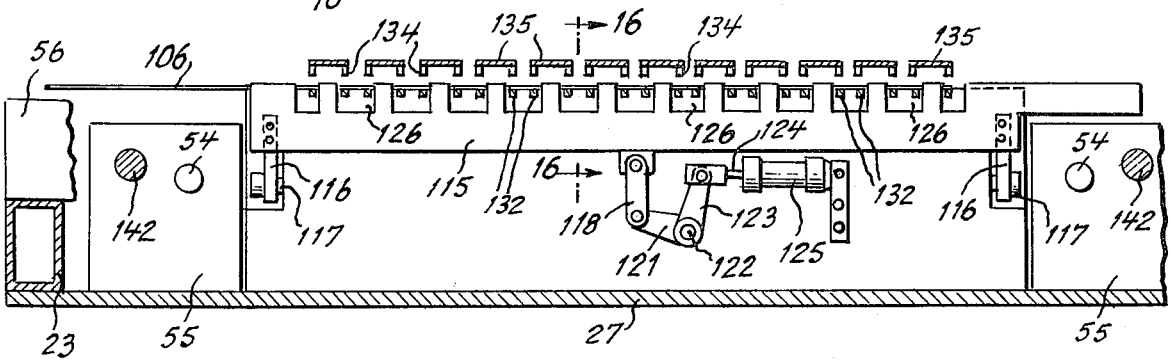
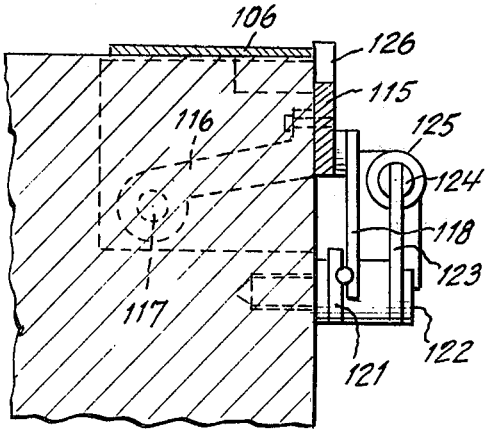
FIG. 16.
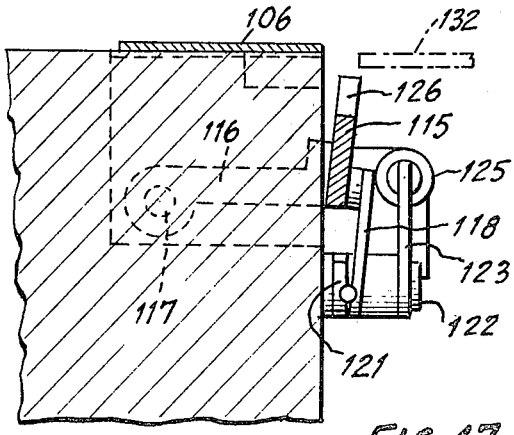
FIG. 17.

SWATCH CUTTING AND BINDING APPARATUS AND METHOD

BACKGROUND OF THE INVENTION

This application relates generally to material handling apparatus and, more particularly, to apparatus for feeding intermittently in step-by-step fashion several distinct webs of flexible fabric in superposed relation to one another as to present the leading edge of the combined web to the bed of a cutting press whereat, by operation of the press, the leading edge portion of the combined web is severed from the remaining portion, the edge portion concurrently being subdivided and also stitched so as to form a series of individual swatch pads, with each pad containing a swatch severed from each ply of the combined web.

The mechanical handling, especially feeding, of flexible web material such as fabric or cloth whether woven or non-woven and whether formed from natural fibers or from synthetic fibers requires that care be taken to avoid stressing the material unevenly which can prevent attainment of the desired feeding objective. This is particularly true when the material being fed is of the more loosely woven or loosely knitted type, due to the greater stretch factor in materials of this type. In applications where the feed is on an intermittent, step-by-step basis rather than continuous, this consideration becomes all the more critical becausing feeding stresses applied to the material to advance it a desired distance are applied repeatedly so as to create a greater chance of unduly stretching or pulling the material out of shape, and in applications where it is desired to feed several webs of different fabrics simultaneously in superposed relation to one another, the problem of avoiding excessive stretching of any one of the superposed webs becomes further compounded especially when the stretch factor of the webs vary from one web to another.

In conventional apparatus designed for handling and feeding a multi-ply web of fabric from a roll unwind stand to a cutting press or the like, the problem of relieving the tension or stretch in the fabric resulting from the unwinding or withdrawing function is customarily minimized by provision of laying-up apparatus to which the fabric is delivered from the unwind stand and before the fabric is transported to the infeed conveyor for the cutting press or similar mechanism. Use of the laying-up apparatus customarily involves withdrawal of a desired length of fabric from the unwind stands by a travelling clamp mechanism or the like and then cutting off the fabric at the desired length to form a lay to spread over a conveyor travelling at the same velocity as the clamping member. Thus, the tension in the fabric and the stretch occasioned by the withdrawal action is relieved and the fabric is free to return to its initial unstressed or untensioned condition. The use of laying-up apparatus for this purpose necessarily requires a considerable amount of floor space and, furthermore, adds substantially to the cost of the overall equipment.

SUMMARY OF THE INVENTION

The apparatus according to present invention operates to withdraw simultaneously several webs of fabric from their respective rolls mounted on an appropriate unwind stand and to feed the several webs superposed upon one another in step-by-step manner to be bed of a cutting press. The withdrawal and feed of the combined fabrics is accomplished by means of a carriage member operating as a shuttle and provided at each end thereof with clamps which grip the fabric on the forward operative stroke thereof. The clamping device on the forward end of the carriage is effective for directing the leading edge of the combined fabrics into the bed of the cutting press while the clamp on the rearward end of the carriage simultaneously operates to withdraw the several fabrics from their rolls on the unwind stand. The two clamping members are activated and deactivated in unison and that portion of the fabric disposed between the two clamping devices is supported by members travelling with the carriage to avoid any frictional drag thereon during operative carriage movement. Thus, that portion of the fabric disposed between the two carriage clamping devices is at no time stressed by the operative movement of the carriage. A third clamping member associated with the carriage but not moveable therewith is activated during those portions of the cycle when the carriage mounted clamping devices are deactivated to retain the carriage immobile along with the combined web, during which time any stretch or tension set up in the fabrics as a result of their being unwound from their supply rolls is relieved.

After the leading edge portion of the combined webs have been advanced into the bed of the cutting press, and assuming it is desired that the resultant swatch pad be formed with a backing material of paperboard or the like, a strip of paperboard carried by a supply roll is fed into the bed of the press in position to underlie the entire leading edge of the combined web of fabric. Thereafter, gripping members mounted on a carriage disposed on the opposite side of the press bed are activated to grip the leading edge of the combined web together with the paperboard backing strip to hold it firmly in position during the cycling of the cutting press. The clamping devices mounted on the first-mentioned web feed carriage are then deactivated and the carriage retracted to a position wherein the web feed clamping device is clear of the press head. The cutting press is then activated, and as the press head descends the cutting knives carried thereby cut off a series of swatches from the leading portion of each of the webs and at the same time cut the paperboard strip into a series of backing sheets for the piles of swatches superimposed thereon. While the press head is still depressed or lowered, stitching devices carried thereon are activated to drive a wire stitch or staple through the superposed swatches of each pile and the paperboard backing sheet underlying each pile so as to form a series of bound pads each including a backing sheet and a swatch from each of the several webs of fabric. Thereafter, the press head is raised and the gripping devices, each still gripping an associated pad of swatches, are retracted by retraction of the carriage on which they are mounted so as to withdraw the swatch pads from the bed of the press to a position where they can be dropped onto a travelling conveyor, upon deactivation of the grippers, to complete the swatch pad fabricating cycle.

All of said foregoing functions are achieved in a fully automatic manner and in a predetermined sequential order from the beginning to the end of a swatch pad fabricating operation. Each of the several functions is performed by mechanism and driven by an associated actuator which in turn is activated under control of the mechanism operated to achieve the preceding function in said sequential order or program. Thus, assurance is given that the mechanism for achieving a particular function will not be operative or effective unless all prior functions in the program of a complete swatch pad fabricating operation have been completed.

It is, therefore, an object of this invention to achieve the fabrication of bound swatch pads from a plurality of cloth or fabric webs in a fully automated manner.

It is a further object of the invention to automatically fabricate bound swatch pads having a backing sheet secured integrally thereto.

A further object of the invention is to improve upon means for feeding a combined plurality of webs of different fabrics to a cutting press or other like apparatus operable thereon.

Further objects of the invention together with the features contributing thereto and the advantages accruing therefrom will be apparent from the following description when read in conjunction with the accompanying drawing.

DRAWING DESCRIPTION

FIG. 13 is a sectional view of the web feeding portion of the apparatus taken along the line 13—13 of FIG. 4.

FIG. 14 is a perspective view of a swatch pad as fabricated by the apparatus.

FIG. 15 is a sectional view of the bed of the cutting press taken along the line 15—15 of FIG. 6.

FIG. 16 is a detail view in section taken along the line 16—16 of FIG. 15 and showing the paperboard guide actuating mechanism with the guide in effective position.

FIG. 17 is a view similar to FIG. 16 but showing the guide in its retracted position.

DETAILED DESCRIPTION

Figure 1:
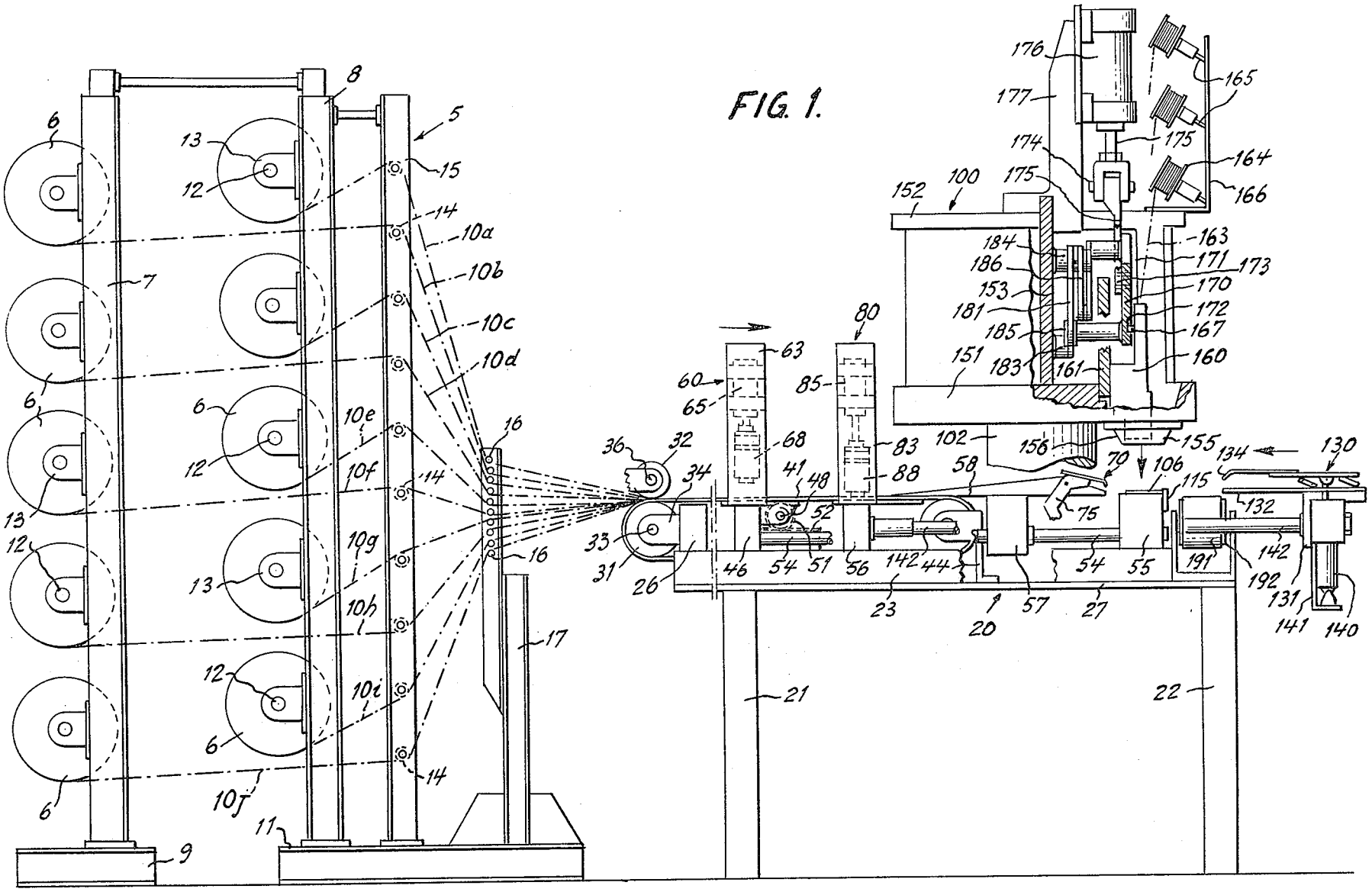
FIG. 1 is an elevational view of the overall apparatus taken from the lefthand side.

Referring now to the drawing, there can be seen in FIG. 1 an unwind stand 5 for the several rolls 6 of web material from which the swatch pads are fabricated. The roll stand may be of any suitable design and, as shown, comprises a framework which includes upright support bars 7 and 8 mounted on pedestals 9, 11. The individual rolls are carried by shafts 12 suitably journaled in bearings 13, secured in suitable spaced apart relation to the upright supports 7. In the present utilization of the invention, the rolls 6 consist of web material of fabric 10*a—j* of differing patterns and/or weaves to result in the fabrication of swatch pads each containing a corresponding number of different swatches or samples. The number of rolls which may be utilized is a matter of choice as is also the width of each roll. All rolls preferably are of the same width, however. Typically, as shown in FIG. 1, there may be provision for ten rolls, with each roll being 24 inches wide. This results in the fabrication during each operating cycle of the apparatus, as will hereinafter be described, of twelve swatch pads each two inches wide and each containing ten swatches.

The respective webs 10*a – j* as they unwind from their respective rolls are led around spaced rollers 14, carried in upright support bars 15, one shown in FIG. I, also mounted on the pedestal 11. The several webs are thereafter brought into actual converging relationship to form a combined web 10 of several superposed plys, as they are drawn into the in-feed mechanism 20 of the apparatus. The in-feed mechanism is supported on a tablelike frame consisting of legs 21, 22 of which there are duplicates, not shown in FIG. 1, on the opposite side of the mechanism. The framework also includes side frame bars 23, 24, see also FIG. 3, in addition to a cross bar 26 and an underlying frame plate 27. The web material in entering the in-feed mechanism is directed by a set of lower rollers or pulleys 31 and a cooperating upper roll 32. The lower rollers 31, of which there are five in the present instance, are freely or rotatively mounted on a shaft 33 carried in brackets 34 secured to the crossbar 26. The upper roll 32 is freely mounted for rotation on a shaft 36 supported in brackets 37 suitably secured to the frame assembly. Wrapped around the lower pulleys 31 are endless belts 41 of any suitable flexible material which extend forwardly in the direction of feed to reach around a corresponding series of pulleys 42 rotatively mounted on a shaft 43 supported in brackets 44, see FIG. 4, secured to the underlying frame plate 27 of the in-feed assembly framework. The belts 41 are snugly drawn around the respective pulleys 31, 42 and serve to support the combined web 10 as it enters the in-feed mechanism. The combined web advances with the upper reach of belts 41 by the action of carriage mounted clamping means hereinafter described.

Figure 3:
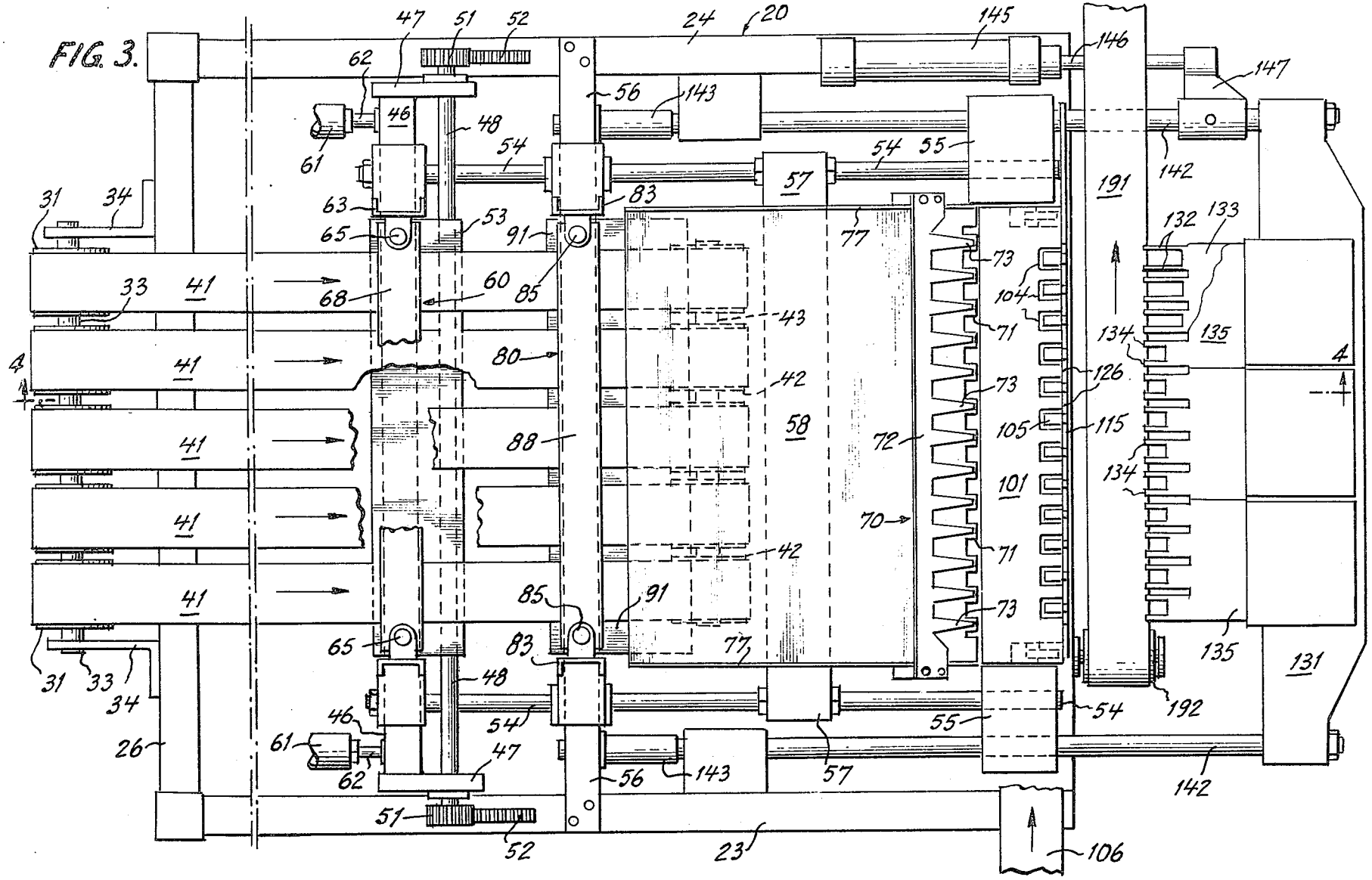
FIG. 3 is a plan view partly in section of the web-feed and cutting portion of the apparatus taken along the line 3—3 of FIG. 4.

The combined web 10 is advanced intermittently into and through the in-feed portion of the apparatus by a shuttle mechanism and associated clamping means which intermittently grip the web and advance it step-by-step toward the cutting mechanism hereinafter described. The clamping devices are mounted on a carriage structure, hereinafter referred to as the shuttle carriage, and includes a tubular crossbar 46 see FIGS. 3, 13 and 18, which underlies the upper reach of the in-feed belts 41. Secured to each end of the crossbar 46 is a bearing member 47 supporting a cross shaft 48. Mounted on each end of shaft 48 is a gear 51 engaging a rack 52 secured to frame bars 23, 24, respectively. Since the shuttle carriage of which the above mechanism is a part is actuated by forces applied at each end of the crossbar 46 the gear mechanism just described will serve to balance the forces applied to the carriage in the event the actuating devices impart forces which are unequal. Secure to the top surface of the crossbar 46 is a plate 53 which underlies the in-feed belts 41 so as to give support to the upper reaches thereof from the weight of the combined web of fabric resting thereon. Also secured to the crossbar 46 and extending in a forwardly direction therefrom are a pair of shafts 54 each slidefitted in a guide block 55 supported by frame plate 27 and a tubular crossbar 56 secured at its ends to the frame bars 23, 24. The shafts 54 near their midpoints are joined to a casting in the form of a crosspiece 57 to which is secured a shuttleplate 58 disposed so as to underlie the leading portion of the combined web 10 as it advances through the in-feed mechanism. The crossbar 46, crosspiece 57 and interconnecting shafts 54 comprise the basic frame assembly for the shuttle carriage which is advanced and retracted at predetermined times in a fabricating cycle as hereinafter to be described. The shuttle carriage is operated by actuators 61, preferably of the pneumatic type, which as can be best seen in FIG. 3 are mounted by any suitable means in the framework of the apparatus and have their pistons 62 connected to opposite ends of the crossbar 46.

The clamping devices mounted on the shuttle carriage include a movable clamp 60 of which the crossbar 46 and the support plate 53 is one of the opposed clamping members. As can be best seen in FIG. 13, the crossbar 46 also supports a pair of opposed upright posts 63 on which are mounted by retainer brackets 64 a pair of pneumatic actuators 65 connected by any suitable means, not shown, to a source of pressurized air. The pistons 66 of the actuators are attached by means of brackets 67 to opposite ends of a tubular bar 68 to the undersurface of which is secured a strip 69 of material which is slightly compressible and has a high coefficient of friction so as to serve as an appropriate clamping surface for the bar 68. Activation of the actuators 65 operates to lower the clamping bar 68 into clamping engagement with the combined web 10, not shown in FIG. 13, resting on the belts 41 and thereby, in cooperation with the underlying bar 46 and support plate 53 firmly hold and retain the combined web 10 in a clamping relationship to the shuttle carriage. Thus, with the clamping bar 68 in clamping relationship with the web material, activation of the shuttle carriage actuators 61 will advance the combined web 10 a predetermined extent and simultaneously withdraw a corresponding amount of fabric from the supply rolls 6, this movement also causing the belts 41 to advance a corresponding extent about their respective pullys 31, 42. Actuators 65 are two-way activatable under control of electrically operated valve means, not shown, of any appropriate type in the pneumatic circuit, so that by activating the actuators reversely the clamping bar 68 is raised to the open position shown in FIG. 13.

Figures 8, 9, 10, 11, 12:
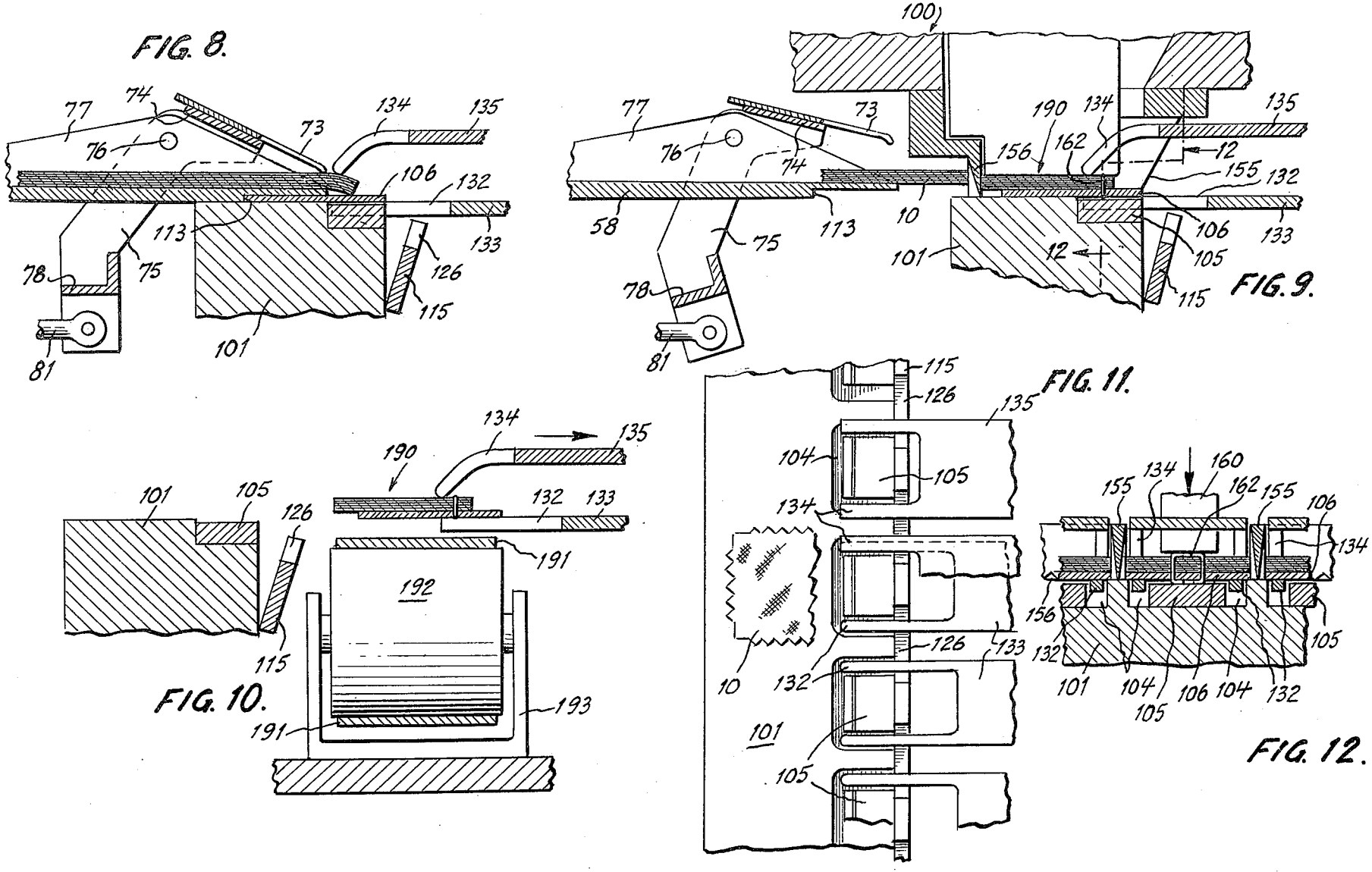
FIG. 8 is an enlarged detail view of a portion of FIG. 4 showing the bed of the cutting press and mechanism associated therewith at the completion of web in-feed, but prior to operation of the cutting press.
FIG. 9 is a detail view similar to FIG. 9 with the parts in the position they occupy during the operation of the press head.
FIG. 10 is a detail view on the same section line as FIG. 8 at the completion of a fabricating cycle.
FIG. 11 is a detail view in plan of parts shown in FIG. 8.
FIG. 12 is a detail view in section taken along the line 12—12 of FIG. 9.
Figure 18:
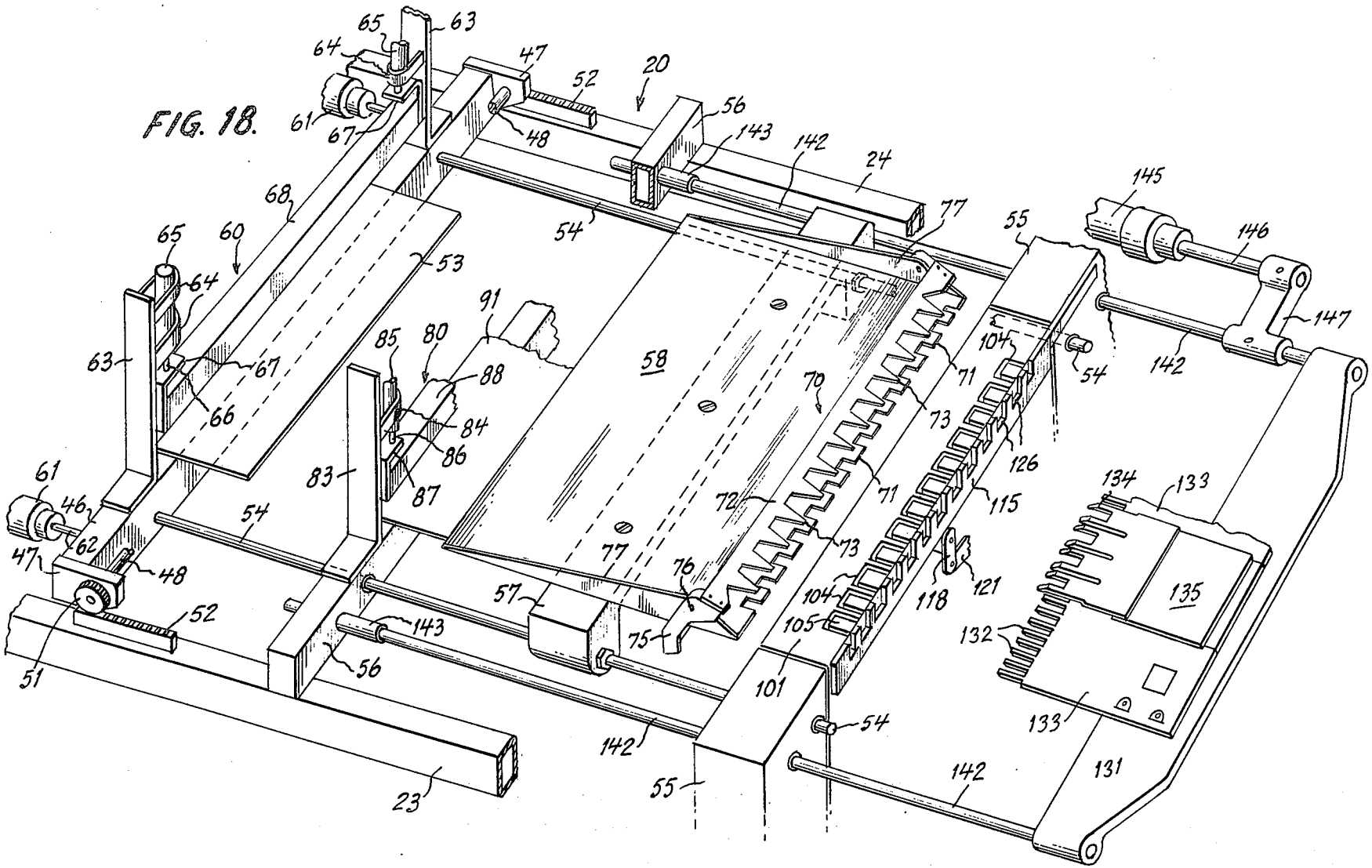
FIG. 18 is an isometric view of the carriage members operable for feeding the combined webs of fabric to the cutting press and for subsequently removing the completed swatch pads from the press.

The other clamping device 70 carried by the shuttle carriage includes the forward edge portion of the shuttle plate 58 as one of the opposed clamping members thereof. The foreward edge of the shuttle plate 58, as can be seen in FIGS. 3, and 18 is notched or cut away with a series of rectangular indentations so as to provide an edge formed with a series of rectangular tongues 71 for reasons which will hereinafter be apparent. Disposed above the leading edge of the shuttle plate is a presser plate 72 having its forward edge in the form of a series of prongs 73 in vertical register with the tongues 71. The presser plate is secured at its ends to the turned-in ear 74, see FIG. 8, 9, of a rockable lever 75 pivotally attached at 76 to the upturned side edge 77 of the shuttle plate 58. The two rock levers 75, one at each side of the shuttle plate, are joined near their lower extremities by an angle bar 78 for bracing purposes and at their lower extremities are connected to the pistons 81 of pneumatic actuators 82 suitably secured to the frame cross piece 57 of the shuttle carriage. Actuators 82 are suitably connected to the pneumatic system of the apparatus and are controlled by electrically operated valve devices so that when activated to close the shuttle clamp the lever 75 will be rocked in a clockwise direction whereby the prongs 73 in cooperation with the tongues 71 of the shuttle plate will firmly grip the combined web 10 of fabrics near its leading edge, as indicated in FIG. 8, and advance the web concomitantly with the advance movement of the shuttle carriage. Activation of the actuators in the opposite direction operates to rock the lever 75 counterclockwise to the open clamp position as indicated in FIG. 9 enabling the shuttle carriage to retract without concurrent movement of the web 10.

It will be seen at the two clamping devices, i.e., the movable clamp 60 and the shuttle clamp 70, reciprocate, i.e., advance and return in unison, since they are both mounted on the shuttle carriage operated by activation of the actuators 61. As will hereinafter be explained in describing an operating cycle of the apparatus, clamps 60, 70 are also operated in unison between their closed and open positions. Thus that portion of web 10 laid out on the in-feed apparatus and lying between clamps 60, 70 is at all times completely free of any force ttending to stretch the web as a result of the feeding and unwinding thereof. Furthermore its weight is supported by the shuttle plate and the belts 41 which advance concomitantly with and at the same velocity as the shuttle carriage.

Also associated with the shuttle carriage, although not mounted thereon, is an unmovable or fixed clamping device 80 which operates to hold the combined web immobile during the non-feed portion of a fabricating cycle when the movable clamp 60 and shuttle 70 are open. The fixed clamp 80 is disposed forwardly of the movable clamp 60 and includes the tubular frame bar 56 as one of the clamping members. Mounted on the top surface of the bar 56 are a pair of posts 83 to which are secured by retainer straps 84, pneumatic actuators 85. The actuator pistons 86 are connected to angle brackets 87, secured to opposite ends of a tubular cross or clamp bar 88, which is thus supported in vertical alignment with the frame bar 56. A gripping strip 89 of material similar to that of the strip 69 is secured to the undersurface of the clamp bar 88 such that activation of the actuators 85 to render the clamp effective will result in lowering the clamp bar 88 to firmly grip the combined web 10 and belts 41 in cooperation with a belt support plate 91, secured to the upper surface of the frame bar 56. The combined web 10 is thus held immobile relative to the frame of the apparatus while the shuttle carriage is being retracted or at such other times of the fabricating cycle when the carriage mounted clamp means 60, 70 are open.

The infeed mechanism of the apparatus as described up to this point operates each swatch pad fabricating cycle to advance the combined web 10 a predetermined distance so as to place the leading edge portion thereof in position to be severed from the balance of the web by automatic cutting means as hereinafter described. In starting up the machine, the individual webs 10*a – j* are drawn off their respective supply rolls, passed around their respective guide rolls 14, 16 and combined with their leading edges in alignment as they are threaded as a combined web 10 through or between the in-feed rolls 31, 32. Thereafter the combined web 10 is passed between the open clamping bars of clamps 60, 80 and through the open shuttle clamp 70 to a point where the leading edge slightly projects beyond the forward edge of the tongues 71 of the shuttle plate 58, the extent of projection being approximately that shown in FIG. 8. With the combined web 10 thus prepositioned relative to the infeed mechanism, the apparatus is ready for an automatic pad fabricating cycle. At the start of the cycle as will hereinafter be more fully described, the clamps 60, 70 are open and the fixed clamp 80 is closed. At an appropriate point of the cycle, clamps 60, 70 close and fixed clamp 80 opens after which the shuttle carriage is driven forward a predetermined extent by activation of its actuators 61 to advance the web into the bed of and over the anvil 101 of cutting press means, partly shown herein and including a press head 100 suitably mounted for a vertical reciprocation on a pair of side pillars 102. The cutting press may be of any suitable commercially available design, preferably operable hydraulicly and electrically controlled. The basic operating functions of the cutting press do not, per se, constitute novel features of the instant invention and only so much of the press is shown herein as is necessary for a clear understanding of the instant invention. The cutting press should, of course, have a peak output force adequate for cleanly crush cutting several plys of fabric and which preferably should be a force upwards of 100,000 pounds. A press found to be entirely adequate and suitable for the purpose is known as a "Hytronic" Series 60 Cutting Press manufactured by the United Shoe Machinery Corporation of Boston, Massachusetts.

The cutting anvil 101 which comprises the bed of the cutting press is suitably supported by the base, not shown, of the cutting press mechanism. As shown, the anvil is supported by the frameplate 27 which in turn is secured to the framework of the press base structure in order to adequately withstand the high forces generated during press operation. The anvil may be of any suitable hardened material and of any appropriate shape having a smooth and flat top surface on which the material to be worked upon can be laid out. As shown, the anvil may be rectangular in cross section wherein the topside serves as the crush cutting surface or platen in cooperation with cutting die or knife means carried by the head 100 of the press apparatus.

For reasons which wil hereinafter become apparent, the upper forward (in relation to the direction of fabric feed) corner of the cutting anvil is cut away to form a series of spaced notches 104 in which are secured stitching anvils 105. In the present instance the apparatus is adapted to handle a combined web of fabric which is 24 inches wide so as to produce 12 bound swatch pads 2 inches wide each fabricating cycle. There are accordingly 12 notches 104, each fitted with an anvil 105, spaced 2 inches apart center-to-center along the said edge of the anvil 101. It should be noted that the anvils 105 do not occupy the total area of the respective notches, but rather each is centered in its respective notch leaving a space or a slot on either side thereof to accommodate gripping means hereinafter to be described. The top surface of each stitching anvil 105 is substantially coplaner with the top cutting surface of the anvil 101 and is formed with appropriately located concavities or recesses designed to cooperate with wire stitching or stapling means hereinafter described.

The shuttle 70 on its forward fabric feeding stroke advances the combined fabric web 10 to a position over the cutting surface of anvil 101 at a point where the leading edge of the fabric web is overlying at least a portion of the notches 104 and anvils 105. The exact point to which the fabric web is advanced depends on the type of pad it is desired to produce, i.e., whether each edge of the swatches is to align with an edge of the swatch backing sheet or is to be offset from an edge of the backing sheet. In the apparatus as disclosed, provision is made for each pad produced by the apparatus to have a backing sheet of paperboard or the like wherein an edge of the paperboard is offset from an edge of the swatches secured thereto thus exposing a marginal portion of the backing sheet along one edge thereof.

Figure 2:
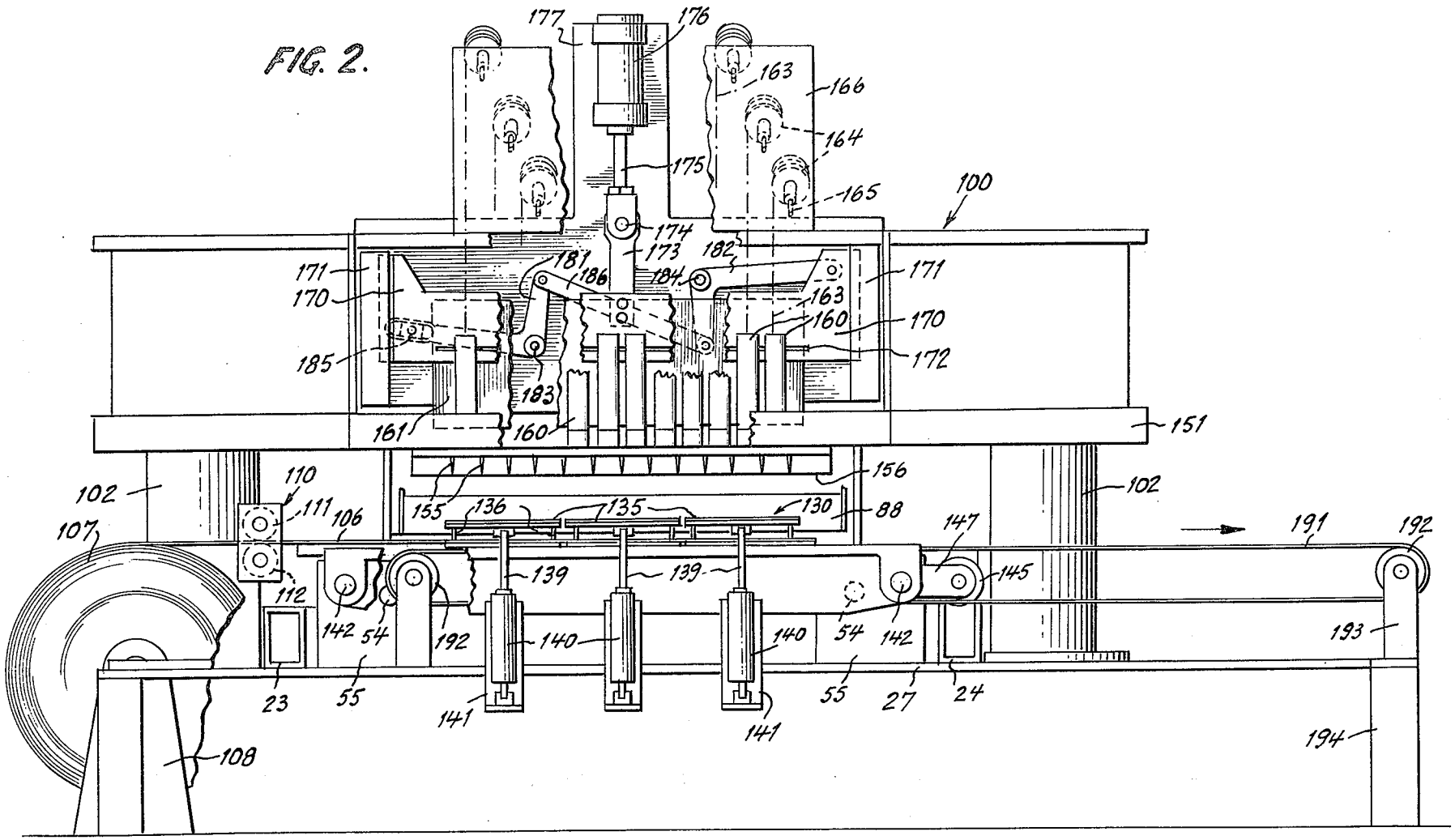
FIG. 2 is a front elevational view of the apparatus.

In the course of a fabricating cycle, after the combined fabric web 10 has been advanced into the bed of the cutting press, to the position shown in FIG. 8, means are provided for feeding a strip of paperboard or the like across the cutting anvil 101 in a direction transverse to the direction of web feed and into the space between the top cutting surface of the cutting anvil and the bottom surface of the shuttle plate 58. As can be seen in FIG. 2, a strip of paperboard 106 is unwound from a supply roll 107 thereof suitably carried by a stanchion or support 108. The paperboard strip is unwound and fed from the supply roll by a paperboard feed device 110 which includes a pair of feed rolls 111, 112 forming a nip whereat the strip is engaged and advanced into the bed of the cutting press. The feed unit 110 may be of any suitable conventional design, preferably electrically operated and controlled, and provided with measuring or counting means settable to limit the feed to only a predetermined measured length of the paperboard upon each activation thereof. In the present instance, the unit 110 is preset or preadjusted to feed 24 inches of the paperboard strip upon each activation thereof so as to place a strip beneath the full width of the combined web 10 of fabric in each fabricating cycle of the apparatus. The paperboard strip as it leaves the feeding unit 110 is appropriately guided so as to enter the bed of the press in the space provided therefor between the bottom surface of the shuttle plate 58 and the top cutting surface of the cutting anvil 101.

As the paper is advanced over the surface of the cutting anvil 101 it is guided along one edge thereof by a step 113 or shoulder formed in the bottom surface of the shuttle plate 58 as can be seen in FIG. 8. As heretofore mentioned, paperboard feed occurs in that part of the fabricating cycle when the shuttle plate 58 is in its most forward or advanced position, the position shown in FIG. 8. The paperboard strip is guided at its opposite edge by a guide bar 115, see also FIGS. 15 – 17, pivotally mounted on the cutting anvil 101 so as to be movable into abutting relation with the forward surface thereof in which position it projects slightly above the top surface of the anvil so as to serve as an edge guide for the paperboard strip as it is being fed into the bed of the cutting press. The paper guide bar 115 is supported near each end thereof by arms 116 pivotally secured at 117 to the cutting anvil 101. Near its mid point the bar is attached to a link 118 having a universal pivotal connection with an arm 121 of a bellcrank mounted on a pivot stud 122 secured to the front surface of the cutting anvil. The other arm 123 of said bellcrank is attached to the piston 124 of a pneumatic actuator 125 supported in a bracket 126 secured to the front surface of the cutting anvil. Activation of the actuator 125 to the position shown in FIGS. 15, 16 causes the paperboard guide to swing about it pivotal mountings so as to lie flush with the front surface of the anvil 101 and into effective guiding position for the strip of paperboard 106. Reverse activation of actuator 126 causes the guide bar 115 to swing away and downwardly to an ineffective guiding position as shown in FIG. 17. The top edge of the guide bar 115 is formed with a series of notches which register with the spaces between adjacent stiching anvils 105 for reasons which will become apparent hereinafter.

Figure 4:
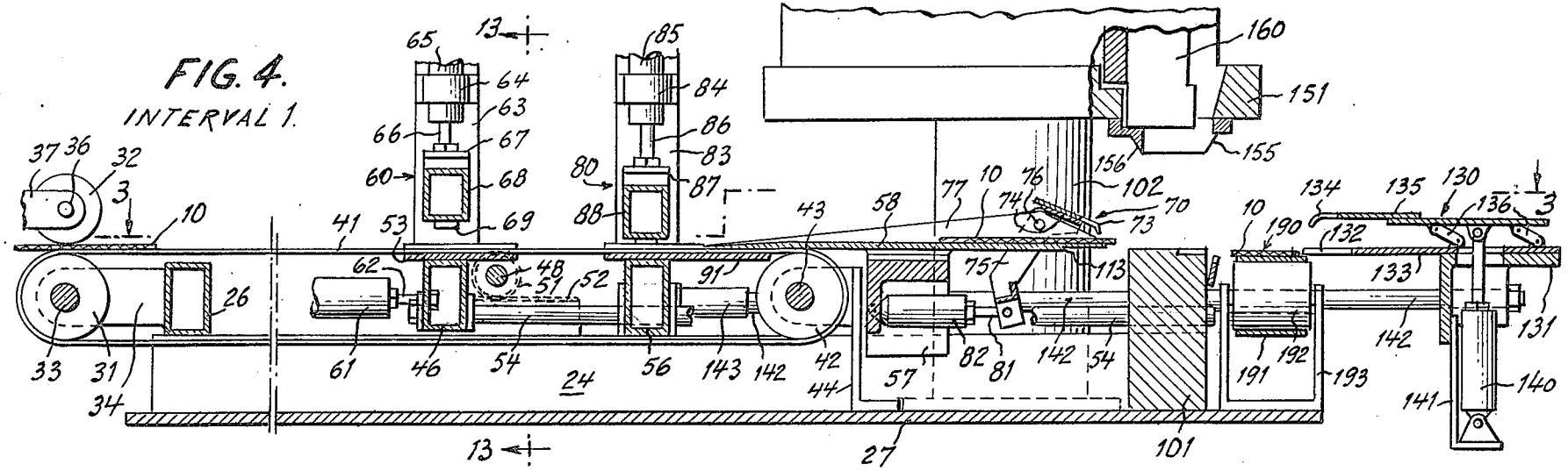
FIG. 4 is an operational view of the web-feed and cutting portion of the apparatus in section and taken along the line 4—4 of FIG. 3.

In order to hold the web 10 and the underlying paperboard strip in proper position in the bed of the press during subsequent operation of the press, at which time the shuttle 70 is retracted, means are provided to grip the combined web 10 and paperboard strip 106 while they are in the bed of the press, which gripping means operate subsequently to cycling of the press to withdraw the bound swatch pads from the press bed in preparation for the next pad fabricating cycle. The gripping means 130 include paired gripper fingers supported on an anuglar casting 131 of a gripper carriage which is reciprocated horizontally to and from the bed of the cutting press at appropriate times of a fabricating cycle. Each pair of gripper fingers includes a lower gripper finger 132, see FIGS. 1, 3 and 4, which structurally are spaced apart extensions formed in the forward edge of a plate 133 secured to the top surface of casting 131. It should be understood that the term "forward" as used herein is intended to define a direction leading to the bed of the cutting press so that with respect to that part of the apparatus located to the left of the cutting press as seen in FIG. 1, the forward direction in the movement thereof would be from left to right, whereas with respect to those parts disposed to the right of the cutting press the forward direction of movement thereof would be reverse to that just mentioned or from right to left as viewed in FIG. 1. The upper gripper finger 134, formed by cutouts in the forward edge of a gripper plate 135, formed in two pieces, is supported by parallel links 136 connecting the plate 135 to the casting 131. In the present instance, as shown, for ease of manufacture the gripper plates 133, 135 are divided into subunits of three each, each subunit having eight fingers so as to provide a total of 24 lower fingers 132 and 24 upper fingers 134 cooperating therewith. Each of the upper plates 135 is pivotally connected to the piston 139 of a pneumatic actuator 140 which in turn is pivotally mounted on an angle bracket 141 secured to the casting 131, the upper horizontal shelf of the casting and the lower gripper plate 133 being suitably apertured to allow clearance for the piston. Activation of the actuator 140 in one direction operates to raise the upper fingers 134 to their open or ineffective gripping position as is shown in FIGS. 1 and 4. Activation of actuator in the opposite direction operates to lower the fingers 134 to their effective closed or gripping position in relation to lower fingers 132 which is the position shown in FIG. 7.

Figure 7:
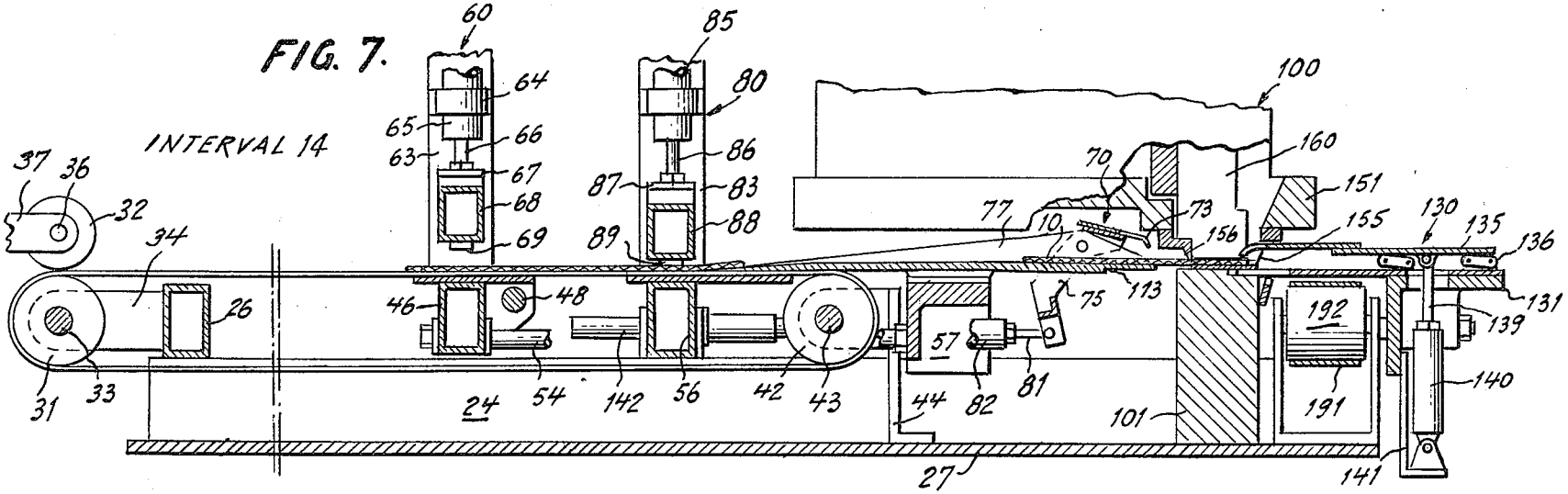
FIG. 7 is still another operational view similar to FIG. 4 and showing the parts in a still later stage of an operating cycle.

The casting 131 on which the gripper mechanism is mounted is supported at each end thereof by shafts 142, see FIG. 18, forming an additional portion of the gripper carriage structure. The shafts are slide-fitted in the guide blocks 55 and sleeves 143, mounted in and extending through the machine frame cross bar 56, so as to thereby support the gripper finger carriage for horizontal reciprocating movement wherein the gripper fingers are advanced into and withdrawn from the bed of the cutting press. The gripper carriage is operated by means of a pneumatic actuator 145 suitably mounted in the frame of the machine and having its piston 146 firmly secured to one of the gripper carriage support shafts 142 by means of a coupler 147. Activation of the piston 145 in one direction moves the gripper finger carriage rearwardly to withdraw the gripper fingers from the bed of the cutting press to the position shown in FIGS. 1, 3, 7 and 18. Activation of the actuator 145 in the opposite direction pulls the gripper finger carriage forwardly so as to bring the gripper fingers into position for gripping the leading edge portion of the combined web 10 of fabric disposed in the bed of the cutting press, the position shown in FIGS. 7 – 9. It will be noted, see also FIG. 12, that the lower gripper fingers 132 lie in a horizontal plane which is slightly below the plane of the cutting surface of the cutting anvil 101, while the tip of gripper finger 134 lies in a horizontal plane somewhat higher than that of the top surface of the cutting anvil. Thus, when the gripper fingers are advanced into the press bed while in their open position or condition, the lower finger 132 will underlie and the upper finger 134 will overlie the leading edge portion of the web 10 and the paperboard strip 106, which materials are firmly gripped when the actuators 140 are subsequently activated to close the gripper fingers to firmly hold the respective materials in the bed of the press as shown in FIGS. 7 – 9. The notches 104 in the top forward corner of the cutting anvil 101 and the notches 126 in the top edge of the paper guide bar 115 allow clearance for the lower gripper fingers 132 when extending into the bed of the press. The spacing between adjacent fingers 132 allows clearance for the stitching anvil 105 fitted centrally within the notches so that when the gripper fingers are fully advanced two adjacent lower fingers 132 will, in effect, straddle each of the stitching anvils 105.

After the gripper fingers close to firmly hold the web 10 and underlying paperboard strip 106 firmly in the bed of the press, the shuttle carriage is retracted by operation of its actuators 61 so as to move the shuttle 70 to a position clear of the press head 100 during an ensuing cycling of the press. In the present instance, the retraction stroke of the shuttle clamp is a longer stroke than the web feed stroke thereof, previously described, in order to achieve the necessary clearance. For this reason, the actuators 61 are designed for a forward advance movement in two stages, the initial stage moving the shuttle to an intermediate position while remaining open thus not advancing the web 10. The second stage of the advance stroke is the web feeding stroke which is accomplished with the shuttle closed.

As soon as the shuttle 70 has been fully retracted to the position shown in FIGS. 7 and 9, the apparatus is in condition for the execution of a cutting press cycle. As can be seen in FIGS. 1 and 2, the head 100 of the cutting press has a frame structure which includes a lower frame plate 151 and an upper frame plate 152 interconnected by a vertical frame plate 153. Mounted on the bottom of the lower plate 151 in any suitable manner and in vertical registration with the cutting anvil 101 are a series of longitudinal cutting dies or knives 155 spaced apart an equal distance and of equal length so as to provide a series of longitudinal slits across the leading edge portion of the combined web 10 positioned on the cutting anvil or platen 101. Also mounted on the bottom of the press head frame plate 151 are a series of transverse cutting dies or knives 156 abutting the rearward edge of the knives 155 so as to cut a continuous line transversely across the combined web 10, intersecting with the rearward limits of the cuts made by the longitudinal knives 155. The cutting tips of knives 155, 156 are formed at least partly in a zig-zag pattern so as to provide a serrated cut in the combined web 10 and paperboard backing 106 when the press head descends in the course of a cutting cycle. The spacing between adjacent knives 155 is equal to the spacing between adjacent notches 104 in the cutting anvil 101, and the knives 155 are vertically aligned with the surfaces of the anvil 101 extending between adjacent notches 104, see FIGS. 3, 11 and 12, so that when the press head descends the knives will have clearance between adjacent gripper fingers 134 and crush cut the combined web and paperboard backing against those portions of the platen surface extending between the notches 104. Thus, in the present instance wherein the combined web 10 is 24 inches wide and it is desired to produce swatch pads 2 inches wide, the spacing between knives 155 is 2 inches so as to thereby result in the cutting out of the leading edge portion of the combined web 12 piles of swatches in each press cycle. The length of the swatch pads is a matter of choice and typically could be three inches.

In the present instance it is desired that the combined swatches 10 of each pad be offset with respect to its paperboard backing support 106 with an edge of the swatches overhanging an edge of the paperboard support 106 as seen in FIG. 14. For this reason, the leading edge of the combined web 10 in preparation for a cutting cycle, as seen in FIG. 9, is advanced to a position somewhat short of the paper guide 115, and the width of the paperboard strip 106 is determined such as to provide overhang for the bottom edge of the swatches. Thus, in this instance, the lateral or transverse cutting knives 156 sever only the combined webs 10 and do not sever the underlying paperboard strip 106. This particular design of a swatch pad is purely a matter of choice shown herein for illustrative purposes. Other designs could readily be produced, including designs wherein the fabric was not offset from its paperboard support, by appropriately adjusting the length of stroke of the shuttle carriage and the gripper carriage and selecting an appropriate width for the paperboard strip 106. Also, if desired, the paperboard strip could be longitudinally folded along one edge, by appropriate placement of a folding plow in its line of feed, so as to fold around the leading edge of the web 10 and thereby result in a pad having a portion of its backing support overlying the top swatch of the pad.

Also mounted in the head 100 of the cutting press are a series of wire stitching devices 160 supported on a vertical frame plate 161 secured to the presshead frame member 151. Any suitable wire stitching device may be employed, and in the present instance there is shown a commercially available unit known as a "Bostitch Wire Stitcher" Model 2601DHD Series, Manufactured by the Bostitch Division of Textron Incorporated of East Greenwich, Rhode Island. This stitching device operates to form individual wire staples 162 from a continuous length of wire 163 supplied thereto and when actuated to eject from its bottom surface the wire staple into underlying material and against a stitching anvil 105 which forces inwardly the legs of the staple to bind together the underlying material into which it has penetrated. The wire stitchers 160 are mounted inn vertical registration with the stitching anvils 105 disposed in the cutouts 104 formed in the cutting anvil 101. The bottom end of each stitcher lies between adjacent cutting knives 155 with the bottom surface of each stitcher lying in a plane slightly above the plane of the cutting edge of the knives 155. Wire 163 is supplied to each stitching device from a spool 164 mounted on a spindle 165 carried by a bracket 166 secured to the upper frame plate 152 of the press head. Each stitching device 160 is provided with a trip lug 167 projecting from the rear wall thereof which when depressed or tripped actuates the device to form the staple and drive it through the underlying fabric as aforesaid.

The mechanism for simultaneously tripping all the stitching devices of the series is designed to equalize the tripping force supplied to each device and includes a trip bar or plate 170 mounted for vertical reciprocation in side guides 171 secured to the frame of the press head 100. The trip plate 170 is formed with a horizontal groove 172 which is disposed to accommodate the trip lugs 167 of the several devices. Secured to the trip plate is a vertical rod 173 pivotally connected by a knuckle joint 174 to the piston 175 of a pneumatic actuator 176 mounted on an upright post 177 supported by the upper frame plate 152 of the press head 100. Activation of actuator 176 in one direction drives the trip plate 170 downwardly to trip the several stiching devices simultaneously, and this occurs in the course of a cutting cycle when the press head is lowered to bring the bottom surface of the stitching devices into contact with the combined web 10 fo fabric in the bed of the press. Activation of actuator in the opposite direction operates to restore several trip lugs 177 to their normal untripped position. The force equalizing mechanism associated with the trip plate 170 includes a pair of bell cranks 181, 182 having arms of equal length and pivotally mounted on studs 183 and 184, respectively, carried by the vertical press head frame plate 153. As shown, the bell cranks 181, 182 are mounted in complementary inverse relation to one another with the short arms thereof being pivotally joiined by a link 186 and the long arms of each bell crank being pivotally connected to opposite sides of the trip plate 170. In the case of bell crank 181 the pivotal connection of the long arm with the plate 170 is in the form of a stud-in-slot connection 185 to allow for a slight amount of lateral motion by the trip plate as it is driven down by actuator 176, with the driving force thereof being equally distributed to opposite sides of the trip plate 170.

FIG. 14 illustrates one of the bound swatch pads 190 produced by a cyclic operation of the cutting press. As shown, the pad 190 is comprised of a section of the paperboard strip 106, serving as a backing sheet or support for the pad, to which is securely bound by a staple 162 a cutoff section of the combined web 10 constituting a pile of swatches which includes an individual swatch of each of the fabrics or webs 10*a–j* forming a layer or ply of the combined web 10.

During the cycling of the cutting press the material being cut and bound by the press operation is retained within the grip of the gripper fingers 132, 134. At the completion of the cutting cycle, when the press head is again elevated, the gripper carriage actuator 145 is activated to withdraw the gripper fingers and thereby remove the completed pads 190 from the bed of the press to the position shown in FIG. 10. Thereafter, the gripper finger actuator 140 is activated to open the gripper fingers so as to release the completed pads at the start of the next cycle.

Preferably means are provided for collecting the completed pads 190 released from the gripper fingers and transporting them to another location such means taking the form of an endless take-away belt 191 underlying the gripper fingers and drawn around pulleys 192. The pulleys are mounted in upright brackets 193, one of which is supported by the frameplate 27 and the other being supported on a stand 194. The belt is continuously driven by a suitable motor and drive means, not shown, so as to receive pads released from the gripper fingers and transport them away from the apparatus where they may be collected for further processing.

Associated with each of the described operating mechanisms which function sequentially in the course of a pad fabricating cycle are electrical switching means disposed and arranged so as to initiate and activate the means for performing the next function in the sequence. In the case of all the operating mechanisms heretofore described, with the exception of the paperfeed mechanism, the switching means take the form of limit switches mounted on the framework in any suitable manner in proximity to its associated mechanism so as to be operated when the associated mechanism is driven to its limit position. Said switching means are shown in FIG. 19 which also portrays schematically the operating mechanisms of the apparatus associated therewith.

Figure 19:
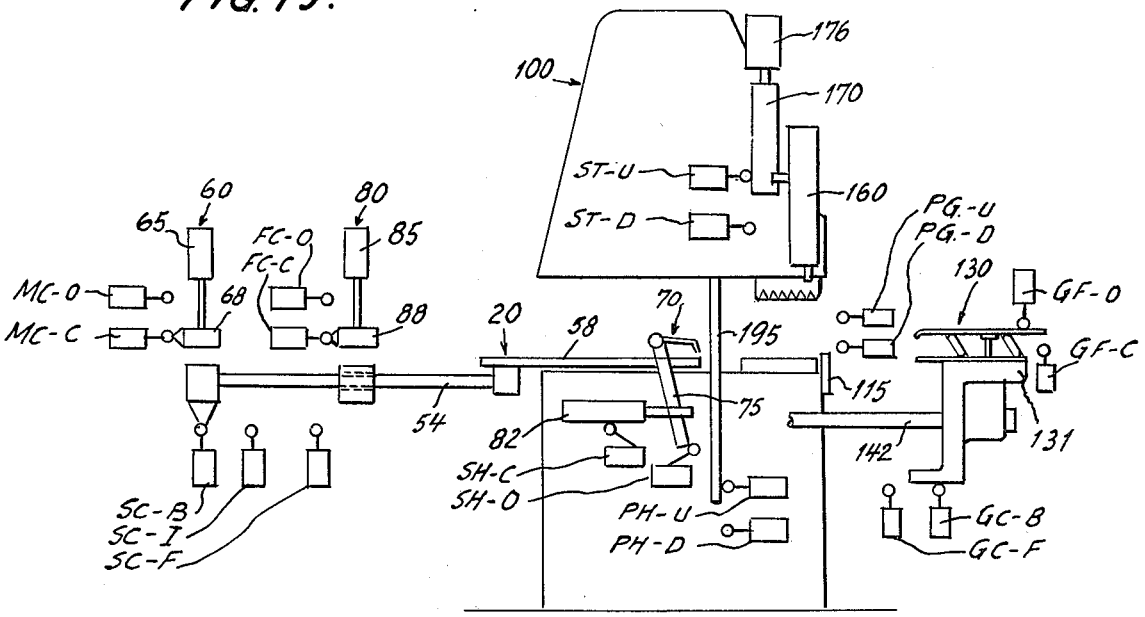
FIG. 19 is schematic view illustrating the operation of the various switching devices controlling the activation and deactivation of the various actuators in a predetermined sequential order in accordance with the program of a swatch pad fabricating cycle.

As seen in FIG. 19, associated with the movable clamp mechanism 60 are limit switches MC-0 and MC-C. The former is closed when the clamping bar 168 is raised to its open position. The latter is closed when the clamping bar is lowered to its closed position. Likewise, associated with the fixed clamp mechanism 80 is a limit switch FC-O operated when the clamp is open and a limit switch FC-C which is operated or closed when the clamp mechanism is closed.

Associated with the shuttle mechanism 70 is a limit switch SH-C which is operated or closed when the shuttle is closed and a limit switch SH-O which is operated to complete its circuit when the shuttle is open. Associated with the shuttle carriage of which shaft 54 is a part is a limit switch SC-B which completes a circuit when the carriage is at its most rearward or back position, a limit switch SC-I which is operated to complete a circuit when the carriage is in an intermediate position, and a limit switch SC-F which is operated to complete a circuit when the shuttle carriage is in its most forward or advanced position. Likewise, associated with the gripper carriage of which shaft 142 is a part is a limit switch GC-B operated when the carriage is in its back or rearward position and limit switch GC-F operated when the gripper carriage is in its most forward position. The gripper mechanism 130 operates limit switch GF-O when the fingers are in their open position and limit switch GF-C when the fingers are in their closed position.

Associated with the paperboard guide bar 115 is a limit switch PG-U operated when the bar is in its upper effective guiding position and a limit switch PG-D which is operated when the bar is lowered to its down or ineffective position.

Associated with the press head 100 through the intermediary of a press head control rod 195 attached thereto is a limit switch PH-U mounted in the base of the apparatus and operated to close a circuit when the press head is in its raised position and a limit switch PH-D operated when the press head is driven down to its lowered effective cutting position. Associated with the stapler trip plate 170 and mounted on the head of the press is a limit switch ST-U operated to close a circuit when the trip bar 170 is in its raised or up position and a limit switch ST-D operated when the trip bar is driven down to its lower or down position.

It will be understood that the closing of a limit switch need not directly activate the actuator for the next function of a fabricating cycle. Rather, the closing of a limit switch preferably activates through conventional circuit means an electrically operated control device, such as a conventional solonoid controlled valve, now shown, which in turn completes a pneumatiic circuit to the respective actuator.

Figure 20:
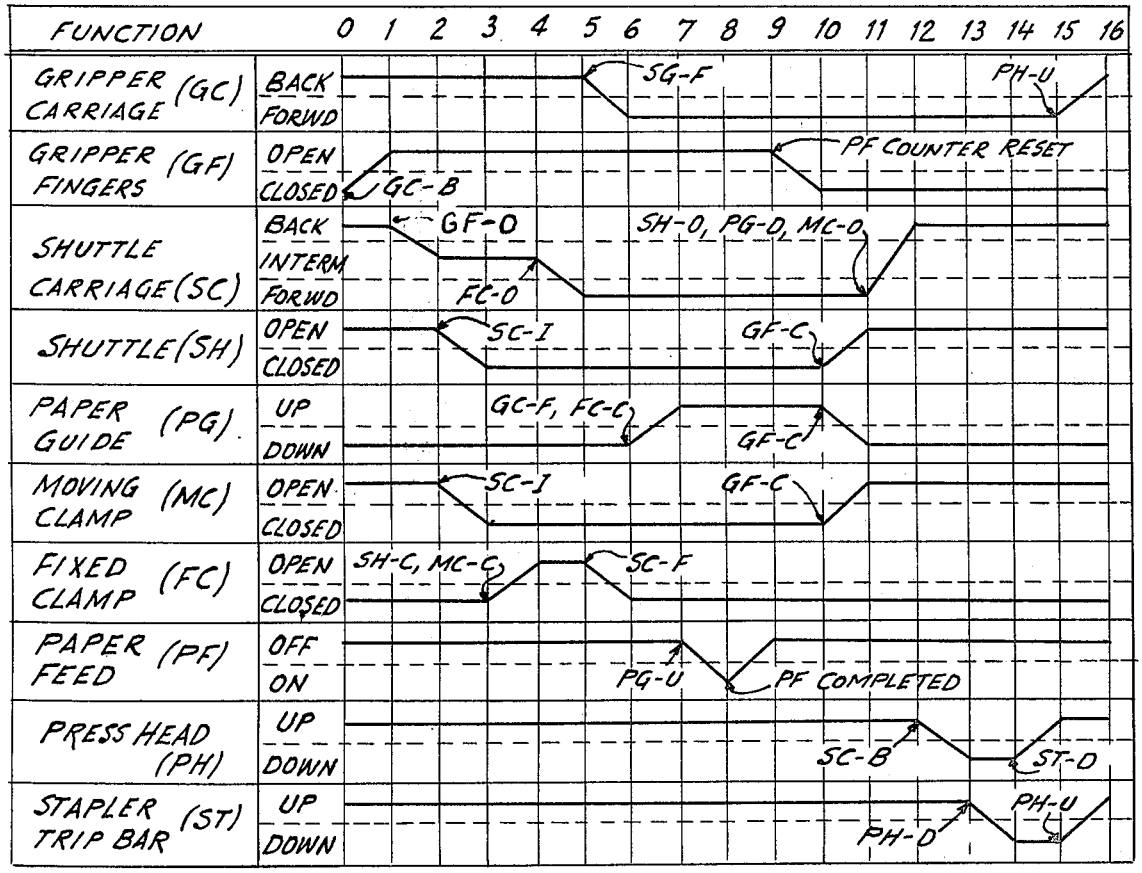
FIG. 20 is a sequence and logic diagram of the various functions performed by the apparatus during the course of a swatch pad fabricating cycle.

FIG. 20 is a sequence and logic diagram showing the sequence in which the various functions of the machine occur during the course of a complete pad fabricating cycle. The diagram also indicates by arrowhead reference the particular limit switch the closing of which in the previous interval is effective for initiating the respective function. Although the intervals are shown on the diagram as being evenly spaced, for illustrative purposes, this should not be interpreted as meaning that the time required for each function is necessarily the same.

At the start of a pad fabricating cycle the various mechanisms are in their respective positions shown in FIGS. 1 and 4 except for the gripper mechanism 130. At the start of the cycle the gripper fingers 132, 134 are closed, in the position shown in FIG. 10, retaining in their grip the pad 190 produced in the preceeding cycle. As indicated in FIG. 20 the gripper carriage is back and the shuttle carriage is back. The shuttle 70 is open and the paperguide 115 is down. The moving clamp 60 is open, and the fixed clamp 80 is closed. The paperfeed 110 is off with its counter reset, the cutting press head 100 is up, and the stapler trip plate 170 is up.

As shown, the function occurring in the first interval of the fabricating cycle is the movement of the gripper fingers from their closed to open position. This is initiated by closing of the limit switch GC-B resulting from retraction of the gripper carriage in the last or 16th interval of the preceeding cycle. This action releases the pad 190 fabricated and withdrawn from the press bed at the end of the preceding cycle which then falls upon the take-away belt 191. FIG. 4 shows the position of the parts at this time.

In the second cycle interval the shuttle carriage advances from its back position to its intermediate position, and this action is initiated by the gripper fingers moving to their open position thereby closing limit switch GF-O. In the second interval the shuttle 70 and the moving clamp 60 are open so that this action of the shuttle carriage does not advance the combined web 10.

In the third interval the shuttle and the moving clamp both close. This action is initiated by the shuttle carriage moving to its intermediate position in the preceeding interval and closing limit switch SC-I.

Figure 5:
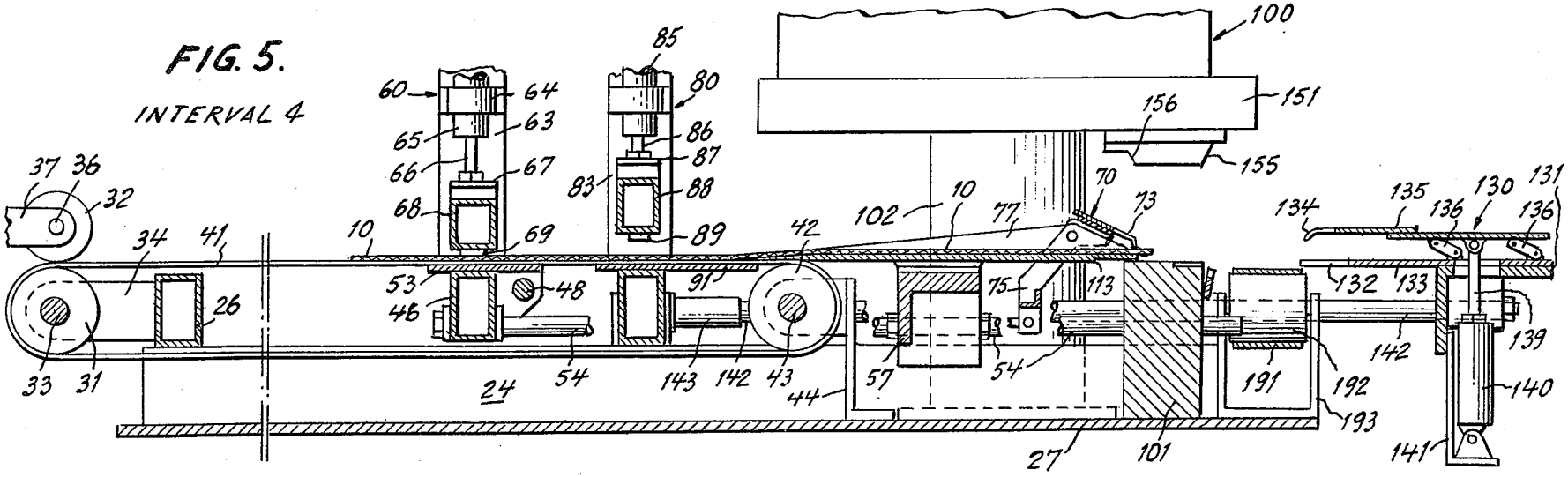
FIG. 5 is an operational view similar to FIG. 4 but showing the mechanism at a later stage of a swatch pad fabricating cycle.

In the fourth cycle the fixed clamp 80 moves from its closed to open position. This is initiated by the opening of shuttle 70 and moving clamp 60 in the previous interval to close limit switches SH-C and MC-C which preferably are connected in series so as to complete a circuit for activating the actuator 85 for the fixed clamp only when both the shuttle and the moving clamp are closed. FIG. 5 illustrates the position of the respective mechanisms at completion of interval four.

In interval five, the shuttle carriage advances from its intermediate position to its most forward position. This action is initiated by the movement of the fixed clamp 80 to its open position whereby limit switch FC-O is closed to complete a circuit activating shuttle carriage actuators 61 for this second stage of shuttle carriage advance. During this fifth interval the shuttle and the moving clamp 60 are closed and thus the advance of the shuttle carriage carries with it the combined web 10 into the bed of the press to the position shown in FIG. 6.

Figure 6:
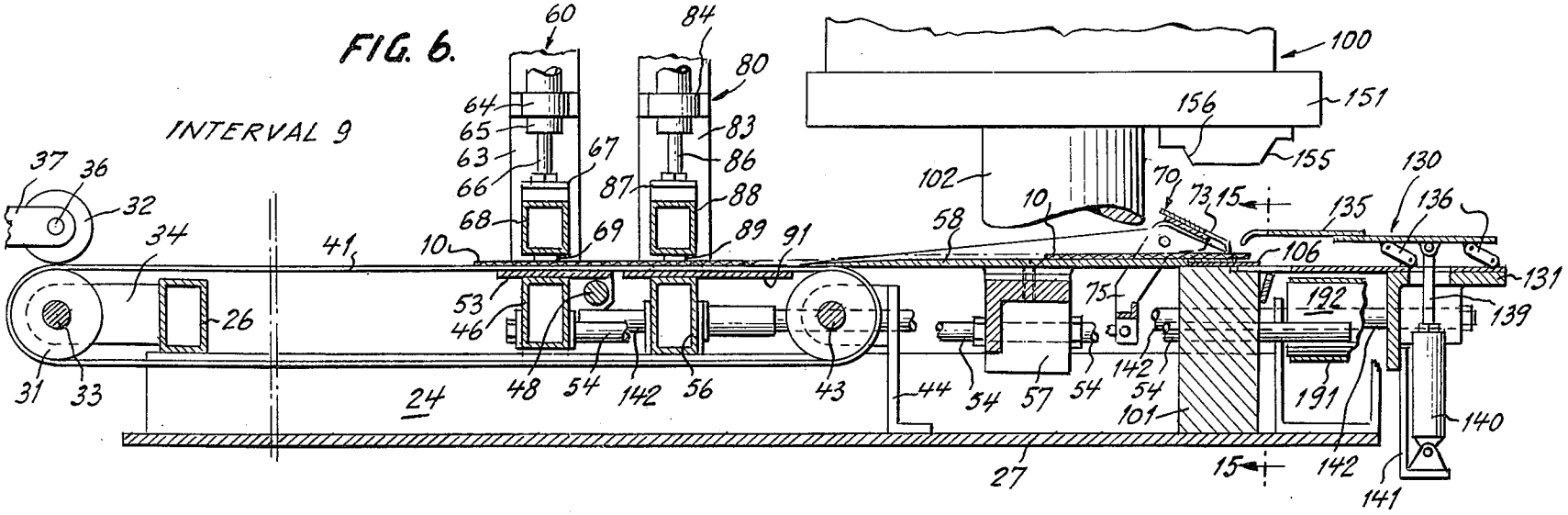
FIG. 6 is another operational view in section similar to FIG. 4, but showing the parts in a still later stage of an operating cycle.

In the sixth interval the fixed clamp 80 returns to its closed position and at the same time the gripper carriage advances to its forward position as shown in FIG. 6. This action is initiated by the shuttle carriage in moving to its forward position and operating limit switch SC-F which closes a circuit for activating the gripper carriage actuator 145 and a circuit for activating the fixed clamp actuator 85.

In the seventh cycle the paperguide 115 swings up to its effective guiding position shown in FIG. 6. This action is initiated by the forward advance of the gripper carriage to operate limit switch GC-F and by the closing of the fixed clamp 89 to operate limit switch FC-C. Said switches are preferably in series and when operated close a circuit for activating the paperguide actuator 125.

In the eighth interval the paperfeed mechanism 110 is activated to advance a strip of paper or paperboard across the surface of the cutting anvil or platen 101 underneath the forward edge of the shuttle plate 71. In the case of the paperfeed mechanism, as aforementioned, it is electrically driven and has associated therewith a counter which stops the feed after a measured length has been fed. There is no limit switch operated thereby and it is activated by a circuit completed by the paperguide limit switch PG-U when the paperguide moves to its up position in the preceeding interval.

After the paperfeed has been stopped by its associated counter to complete the eightth interval, the counter is designed to be automatically reset and this occurs in the nineth interval of the cycle. FIG. 6 illustrates the positions of the respective parts at the completion of the ninth cycle interval.

In the tenth interval of the cycle the gripper fingers 132, 134 close to grip the leading edge of the combined web 10 and the paperboard strip 106 to hold them firmly in the bed of the press as is shown in FIG. 8. this action is initiated by completion of the paperfeed and resetting of the counter associated therewith.

In the eleventh interval the shuttle 70 opens, the paperguide 115 retracts to its down position and the moving clamp 60 opens. This action is initiated by the closing of the gripper fingers in the preceeding interval to operate the gripper finger limit switch GF-C which completes the circuits for activating the shuttle actuator 82, the paperguide actuator 125 and the moving clamp actuator 65.

In the twelfth interval of the cycle the shuttle carriage is fully retracted to its back position. Since at this interval of the cycle the gripper fingers and the fixed clamp are closed while the shuttle and the moving clamp are open, this action of the shuttle carriage does not effect the position of the combined web 10 in the apparatus. This retraction of the shuttle carriage is initiated by reason of the operation, in the preceding interval, of the shuttle limit switch SH-O, the paperguide limit switch PG-D and the moving clamp limit switch MC-O. These switches are preferably connected in series so as to complete a circuit to the shuttle carriage actuators 61 when the shuttle and the moving clamp open and the paperguide lowers at the completion of the preceding interval of the cycle. The retraction of the shuttle carriage at this time serves to withdraw the shuttle mechanism 70 from the bed of the press to a position where it will be clear of the press head 100 when it subsequently descends to cut that portion of the combined web 10 positioned in the bed of the press. The retraction of the shuttle carriage serves to operate the shuttle carriage limit switch SC-B to complete a circuit for activating the function of the next or thirteenth interval.

In the thirteenth interval the circuit completed by limit switch SC-B serves to activate the cutting press whereby the press head 100 is driven downwardly to effect cutting by the knives 155, 156 of the combined web 10 and the paperboard strip 106 positioned in the bed of the press on anvil 101. the cutting press, as aforementioned, is a commercially available machine, hydraulically operated, and internally controlled so as to effect only one cutting cycle at a time and until again activated in the following pad fabricating cycle.

In the fourteenth interval as the press head remains in its down position the stapler trip bar 170 is actuated to cause the staplers 160 to drive a staple 162 through each pile of swatches and underlying paperboard which had been cut from the combined web 10 and underlying paperboard strip 106 by the lowering of the presshead in the preceeding interval. FIGS. 7 and 9 show the parts in the position they assume at completion of the fourteenth interval of a pad fabricating cycle. This stapling action in the fourteenth interval is initiated by the lowering of the presshead in the previous interval which operated press head limit switch PH-D to close the circuit to activate the stapler trip actuator 176.

In the fifteenth interval the press head is restored to its upper position. This action is initiated by a circuit completed by the stapler trip plate limit switch ST-D which is operated when the stapler trip plate is driven to its down position in the preceeding interval.

In the sixteenth or final interval of a pad fabricating cycle, the stapler trip plate is restored to its upper position and the gripper carriage is retracted to its back position to withdraw the completed bound pad of swatches 190 from the bed of the press. This action in the sixteenth interval is initiated by the presshead returning to its up position and operating its limit switch PH-U to activate the stapler trip actuator 176 and the gripper carriage actuator 145. FIG. 10 illustrates the position of the gripper fingers as retracted and gripping the completed pad 190 as the pad fabricating cycle comes to an end at the completion of the sixteenth interval. As heretofore mentioned the gripper fingers open at the beginning of the pad fabricating cycle to release the pads which drop onto the take-away belt 191.

While there has been shown and described what is considered to be a preferred embodiment of the invention, it will of course be understood that many changes in form and detail could be made to the apparatus herein shown and described without departing from the spirit of the invention. It is, therefore, intended that the invention be not limited ot the exact form and details herein shown and described nor to anything less than the whole of the invention as hereinafter claimed.

What is claimed is:

1. Apparatus for fabricating pads of swatches representative of serveral distinct webs of flexible fabric supplied thereto simultaneously in superposed relationship as a combined web of several plies, comprising a. cutting press means including an anvil for supporting the leading edge portion of said combined web in position for cutting thereof by said press means, and a press head cyclically reciprocable to and from said anvil and mounting thereon cutting knives arranged to cut off the leading edge portion of said combined web during a cyclic reciprocation thereof, b. in-feed means for intermittently advancing said combined web onto said anvil includingg a preciprocable carriage disposed to support the leading edge portion of said combined web, said carriage including means for clamping the leading edge portion of said combined web to said carriage during the web advance movement thereof, and c. means for gripping said leading edge portion after advance thereof by said clamping means, said gripping means including carriage mounted fingers for holding said leading edge portion on said anvil during cutting thereof by said knives and withdrawing said portion from said anvil after being cut off from said web by said knives.

2. The invention according to claim 1 wherein a. said carriage includes means operable in unison with said clamping means for clamping a trailing portion of said combined web to said carriage.

3. The invention according to claim 1 including a. fixed means independent of said carriage and operable when said clamping means are ineffective for clamping a trailing portion of said combined web to prevent movement thereof by said carriage.

4. The invention according to claim 1 including a. means of said carriage operable in unison with said clamping means for clamping a trailing portion of said combined web to said carriage, and b. fixed means independent of said carriage and operable when said first and second mentioned clamping means are ineffective, for clamping said combined web to prevent movement thereof by said carriage, said fixed means clamping a portion of said web between said trailing portion and said leading edge portion.

5. Apparatus for fabricating pads of swatches representative of several distinct webs of flexible fabric supplied thereto simultaneously in superposed relationship as a combined web of several plies, comprising a. a cutting press including anvil means for supporting the leading edge portion of said combined web in position for cutting thereof by said press, said press including a press-head cyclically reciprocable to and from said anvil, said press-head mounting thereon cutting knives arranged to cut off the leading edge portion of said combined web and stapling means for driving a staple into the leading edge portion of said combined web during a cyclic reciprocation of said press head, b. in-feed means for intermittently advancing said combined web to said anvil means including a reciprocable carriage disposed to support the leading edge portion of said combined web, said carriage including means for clamping the leading edge portion of said combined web to said carriage during the web advance movement thereof, and c. means for gripping said leading edge portion after advance thereof by said clamping means, said gripping means including carriage mounted fingers for holding said leading edge portion on said anvil during the cutting and stapling thereof by said knives and said stapling means and for withdrawing said portion from said anvil after being cut off from said web by said knives.

6. The invention according to claim 5 wherein, a. said anvil means includes a stapling anvil cooperating with said stapling means for securing a staple in said web portion.

7. The invention according to claim 5 wherein, a. said cutting knives are arranged longitudinally and laterally and operate to cut off said leading edge portion in a plurality of separate sections.

8. The invention according to claim 7 wherein, a. said stapling means includes a separate device dsposed to drive a staple through each of said web sections, and b. said anvil means includes a separate anvil disposed to cooperate with each said separate stapling device.

9. Apparatus for fabricating pads of swatches representative of several distinct webs of flexible fabric supplied thereto simultaneously in superposed relationship as a combined web of several plies, comprising a. cutting press means including an anvil for supporting the leading edge portion of said combined web in position for cutting by said press means, and a press head cyclically reciprocable to and from said anvil and mounting thereon cutting knives arranged to cut off the leading edge portion of said combined web during a cyclic reciprocation thereof, said press means including a stapling mechanism operable during reciprocation of said presshead to bind together with a staple the several plies of said leading edge portion, b. in -feed means for intermittently advancing said combined web onto said anvil including a reciprocable carriage disposed to support the leading edge portion of said combined web, said carriage including means for clamping the leading edge portion of said combined web to said carriage during the web advance movement thereof, c. means for advancing a strip of backing material onto said anvil in a direction transverse to the direction of web advance to a position underlying said leading edge portion, and d. means for gripping said leading edge portion and said backing material after advance thereof onto said anvil, said gripping means including carriage mounted fingers for holding said leading edge portion and said backing material on said anvil during reciprocation of said press head and for withdrawing said web portion and said backing material from said anvil after reciprocation of said press head, said stapling mechanism when operated to bind together said several plies of said web portion also securing thereto said backing material with said staple.

10. The invention according to claim 9 including a. means for guiding the advance of said backing material strip onto said anvil, said guiding means comprising a guide bar movable into position alongside said anvil and above the top surface thereof for guiding contact with one edge of said strip.

11. The invention according to claim 9 wherein said clamping means includes a plate member supporting said leading edge web portion and including a. means for guiding the advance of said backing material strip onto said anvil, said guiding means comprising a step formed in the under surface of said plate and disposed for guiding contact with one edge of said strip when said plate is in its advanced position.

12. The invention according to claim 9 wherein said clamping means includes a plate member supporting said leading edge web portion, and including means for guiding the advance of said backing material onto said anvil, said guiding means comprising a. a guide bar moveable into position alongside said anvil and above the top surface thereof for guiding contact with one side edge of said strip, and b. a step formed in the under surface of said plate member and disposed for guiding contact with he opposite side edge of said strip when said plate member is in its advanced position.

* * * * *

UNITED STATES PATENT AND TRADEMARK OFFICE

CERTIFICATE OF CORRECTION

PATENT NO. : 3,991,926

DATED : November 16, 1976

INVENTOR(S) : William M. Marks

It is certified that error appears in the above-identified patent and that said Letters Patent are hereby corrected as shown below:

Column 15, line 48 - change "89" to "80"

Signed and Sealed this

Fifteenth Day of March 1977

[SEAL]

*Attest:*

RUTH C. MASON
*Attesting Officer*

C. MARSHALL DANN
*Commissioner of Patents and Trademarks*